US005377892A

United States Patent [19]

Kimball

[11] Patent Number: 5,377,892

[45] Date of Patent: Jan. 3, 1995

[54] FLUID PRESSURE TENSIONING APPARATUS FOR A WEB THREADING ENDLESS ROPE

[75] Inventor: Charles D. Kimball, Yellow Springs, Ohio

[73] Assignee: Wespatt, Inc., Springfield, Ohio

[21] Appl. No.: 105,149

[22] Filed: Aug. 12, 1993

[51] Int. Cl.[6] ..... B65H 59/38

[52] U.S. Cl. ..... 226/92; 226/118; 226/195; 474/104; 34/117; 162/193

[58] Field of Search ..... 162/193, 255; 34/117, 34/120; 226/92, 118, 195; 474/104

[56] References Cited

U.S. PATENT DOCUMENTS

| | | | |
|---|---|---|---|
| 3,175,444 | 3/1965 | Spinney | 226/119 X |
| 3,414,208 | 12/1968 | Butler, Jr. et al. | 226/119 X |
| 3,501,075 | 3/1970 | Scharf | 226/25 |
| 3,540,642 | 11/1970 | Riegel | 226/195 X |
| 3,643,497 | 2/1972 | LeCompte | 226/195 X |
| 4,049,168 | 9/1977 | Cole et al. | 226/44 X |
| 4,186,861 | 2/1980 | Steinhilber | 226/118 |
| 4,288,014 | 9/1981 | Evers | 226/44 |
| 5,263,623 | 11/1993 | Bracken | 226/92 |

OTHER PUBLICATIONS

Catalog Sheets of Wespat Rope Stretcher.

Kenbest Pneumatic Tensioner by William Kenyon & Sons, Inc.—approximately 1990.

*Primary Examiner*—Andrew M. Falik

*Attorney, Agent, or Firm*—Jacox & Meckstroth

[57] ABSTRACT

A compact rope stretcher maintains the tension in an endless rope used for threading a web in a papermaking machine and includes a beam having a flange forming a track which is engaged by guide wheels supporting a pair of separate carriages. The carriages support corresponding rope sheaves for free rotation, and a pair of fluid cylinders are mounted on the beam and enclose pistons connected by corresponding piston rods directly to the corresponding carriages. The beam may be mounted on the papermaking machine with its track-forming flange extending at an angle to the horizontal so that the respective piston rods extend upwardly and downwardly from the cylinders. Pressurized fluid is supplied to the upper end of the one cylinder having the downwardly extending piston rod, and the upper end of the other cylinder is vented to atmosphere. The lower ends of the two cylinders are interconnected by a fluid passage to form a closed circuit which is filled with hydraulic fluid. The fluid causes upward movement of the piston in the other cylinder in response to downward movement of the piston having the downwardly extending piston rod and counterbalances the weights of moving components.

10 Claims, 2 Drawing Sheets

FLUID PRESSURE TENSIONING APPARATUS FOR A WEB THREADING ENDLESS ROPE

RELATED APPLICATION

This application is related to application Ser. No. 07/783,425, filed Oct. 28, 1991, U.S. Pat. No. 5,263,623, and assigned to the assignee of this application.

BACKGROUND OF THE INVENTION

In machines for producing a web of paper or paper board, it is common to direct an endless rope or a pair of endless ropes around the end portions of a series of rolls, such as the rolls of the dryer section or a set of calender rolls, for gripping and threading through the rolls the leading end portion of a web, usually referred to as a "tail". When a single rope is used, it is directed twice around the rolls so that two adjacent ropes extend through the rolls and are effective to pinch the tail and thread it around the rolls. The rope may have a diameter ranging from ¼" to 5/8" and is usually made of spun nylon filaments or of natural fibers. The rope stretches over a period of use, especially when the rope is driven at a higher speed, for example, over several thousand feet per minute. The ropes can stretch from 7% to 10% within a few days or within a few months depending upon the speed of the papermaking machinery. In the dryer section, the length of the endless rope is frequently between 200 feet and 400 feet so that a 7% to 10% stretch requires substantial take up in the rope in order to maintain the desired rope tension.

In prior art rope stretchers, various types of elongated Frames have been fabricated from metal rods and bars of various shapes, and the fabricated steel frames support movable carriages. Flexible cables extend from the carriages around corresponding stationary guide pulleys and also around movable pulleys supported by the extendable piston rods of air cylinders. In such a rope stretcher, it is desirable to simplify its construction and to reduce the number of moving parts so that servicing is minimized or substantially eliminated thereby avoiding down time of the papermaking machine in the event the rope stretcher is not properly serviced. It is also desirable to maintain constant tension in the rope during threading operation to provide dependable and efficient threading of a web tail and to obtain maximum service life from the rope. In addition, it is highly desirable to provide a more compact rope stretcher having a lighter weight and greater strength as well as a rope stretcher which may be installed in any position or orientation on papermaking machinery.

The above mentioned application Ser. No. 07/783,425 discloses an improved rope stretcher which provides all of the desirable features and advantages mentioned above, and which is especially simple, economical and dependable in construction. That rope stretcher further eliminates the need to fabricate an elongated track and the use of cable and pulley systems, and it may be easily constructed in various sizes and lengths depending on the length and stretch of the rope and the desired tension in the rope.

In one embodiment of a rope stretcher disclosed in the above mentioned application, an elongated precision track is formed by an H-beam having parallel flanges integrally connected by a center web. Opposite end portions of the beam are supported by mounting brackets, and one of the flanges supports a pair of adjacent parallel carriage plates by a set of sealed anti-friction guide wheels which positively engage opposite longitudinal edge portions of the flange.

Each of the carriage plates supports a rope sheave for free rotation by a sealed anti-friction bearing and is directly connected by a link member to the end portion of a piston rod projecting from a corresponding elongated fluid or air cylinder mounted on the web of the beam. A pair of proximity sensors are mounted on opposite end portions of the beam to detect the presence of the carriages and actuate a signal or alarm when the stretch in the rope is approaching a limit. A longitudinally extending cover extends over the beam and carriages to protect the carriages and fluid cylinders.

When the above described rope stretcher is mounted at an angle to the horizontal, the weight of the cylinder piston, piston rod, carriage, sheave and connecting parts which move downwardly to tension the rope add to the force produced by the corresponding cylinder. The weight of the corresponding parts which move upwardly to tension the rope counteracts that cylinder's force. This creates a situation causing improper and variable rope tension depending on whether the downward moving sheave has reached the end of its stroke.

SUMMARY OF THE INVENTION

The present invention is directed to a rope stretcher that overcomes gravity factors affecting rope tension when the stretcher is not mounted in a horizontal position. The stretcher is designed and constructed for installation on papermaking machines where it is not possible or practical to mount a rope stretcher in a horizontal position, and the stretcher must be mounted in a vertical or inclined position.

Special provision is made in accordance with the invention for counterbalancing these counter-acting gravity forces. For this purpose, opposite end portions of the two cylinders are connected by a fluid conduit, and this conduit and the portions of the cylinders connected thereby are filled with hydraulic fluid to form a closed circuit. Thus the force produced by the weight of the parts moving downwardly to tension the rope is transmitted to counterbalance the weight of the parts moving upwardly to tension the rope.

Other features and advantages of the invention will be apparent from the following description, the accompanying drawings and the appended claims.

DESCRIPTION OF THE PREFERRED EMBODIMENT

Figure 1:
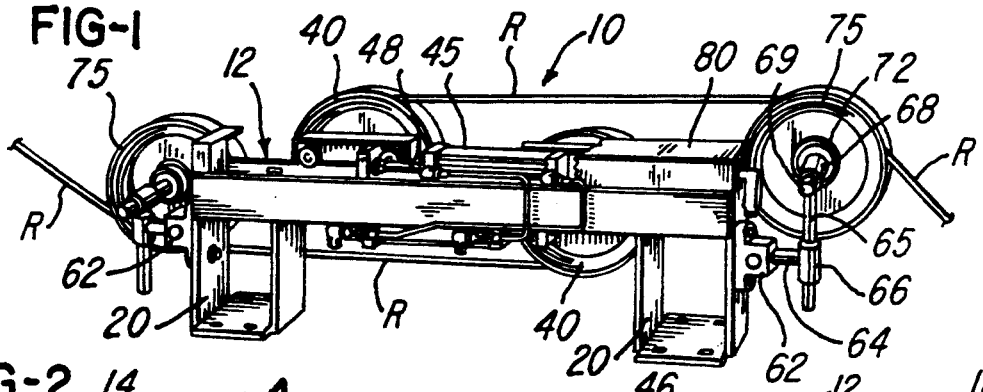
FIG. 1 is a perspective view of a rope stretcher or tensioning apparatus disclosed in the above mentioned application and with a portion of a cover guard broken away to show internal assembly.

FIG. 1 illustrates a rope tensioning apparatus or rope stretcher 10 as disclosed in the above mentioned application and through which extends an endless rope R that may have a diameter of about one half inch and may be constructed of spun nylon filaments or natural fibers. As used herein, the term "rope" includes any flexible endless element which is used to grip the tail of a web of material for threading the web through a series of processing rolls.

The rope stretcher 10 includes an elongated frame 12 (FIG. 4) formed by a steel H-beam having a pair of parallel flanges 14 integrally connected by a web 16. The size of the H-beam frame 12 is selected according to the length and expected stretch of the rope R and the desired tension within the rope. For example, the flanges 14 may have width ranging between three inches to fourteen inches and the length may range between five feet and twenty feet. The H-beam frame 12 has opposite end portions 18 which are supported by corresponding U-shaped mounting brackets 20 preferably welded to the end portions of the beam.

Figure 2:
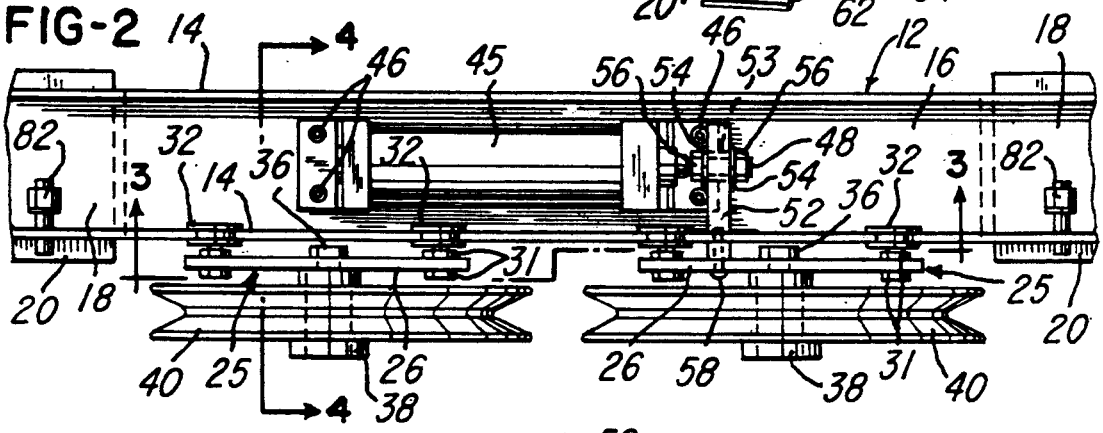
FIG. 2 is a fragmentary plan view of the apparatus shown in FIG. 1.
Figure 3:
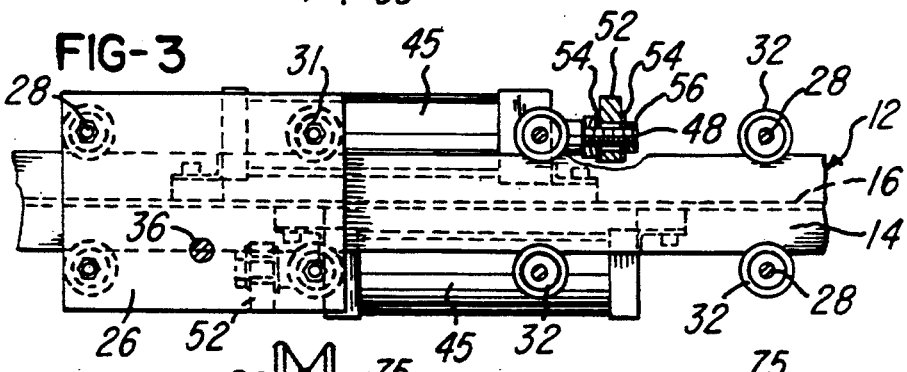
FIG. 3 is a fragmentary section taken generally on the line 3—3 of FIG. 2.
Figure 4:
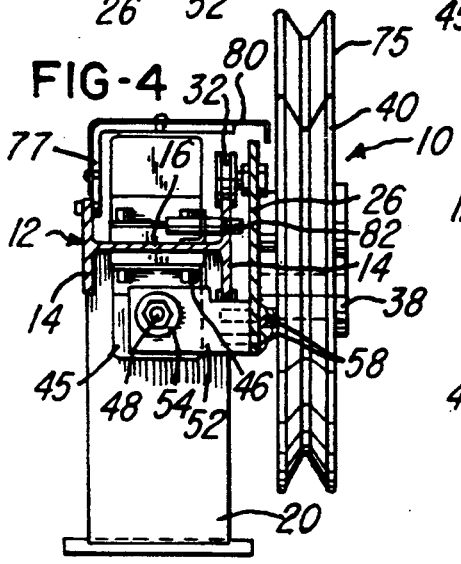
FIG. 4 is a section taken generally on the line 4—4 of FIG. 2.

As shown in FIGS. 2–4, a pair of carriages 25 are supported for smooth longitudinal movement by one of the flanges 14 of the beam 12, and each carriage 25 includes a rectangular carriage plate 26 having a width greater than the width of the adjacent parallel flange 14. A set of four stainless shafts 28 are secured to the corner portions of each of the carriage plates 26 by a set of threaded nuts 31, and each shaft 28 supports a stainless steel spool-like guide wheel 32 having a sealed antifriction bearing mounted on the shaft 28.

The guide wheels 32 on each carriage plate 26 are grooved to engage closely the opposite longitudinally extending edge portions of the adjacent beam flange 14 and support the carriage plate 26 for smooth and precision linear movement along the length of the beam 12. A locking nut 36 is located on the inner side of each carriage plate 26 and is threaded onto the end portion of a shaft 38 which supports a rope sheave 40 having a sealed anti-friction center bearing mounted on the shaft 38 to provide free rotation of the sheave 40.

An elongated fluid cylinder 45 is mounted on the web portion 16 of the H-beam 12 for each of the carriages 25, with the cylinders 45 located on opposite sides of the web 16. Each of the cylinders 45 is secured by a set of screws 46 and includes a piston rod 48 having a threaded outer end portion. A laterally projecting link member 52 has a bore 53 which receives the outer end portion of the rod 48, and the bore 53 is somewhat larger than the diameter of the rod 48. A pair of flat washers 54 and corresponding nuts 56 retain the link member 52 on the rod 48 adjacent a pair of opposing cup-shaped spring washers which permit the link member 52 to float laterally by a slight amount relative to the rod 48 to avoid any lateral stress on the piston rod.

A pair of screws 58 rigidly secure each of the link members 52 to the corresponding carriage plate 26 so that axial movement of the piston rod 48 of each cylinder 45 is effective to move the corresponding carriage 25 and sheave 40 longitudinally on the track formed by the supporting beam flange 14. The cylinders 45 are connected to fluid supply lines (not shown) which extend from a control system (not shown) which is adjusted to control the pressure of the fluid supply to the cylinders 45. The fluid pressure behind the piston rods 48 normally urges the rods 48 outwardly for urging the carriages 25 longitudinally towards the opposite corresponding end portions 18 of the H-beam 12.

As shown in FIG. 1, a block 62 is mounted on the outer end of each beam support bracket 20 and supports a rod 64 to which is secured a cylindrical bushing 66. Another rod 65 is adjustably supported by the bushing 66 and is secured to another bushing 68. The bushing 68 supports an axially adjustable shaft 69 on which is mounted an anti-friction bearing 72 supporting a freely rotatable rope guide sheave 75.

As also shown in FIG. 1, the endless rope R extends under one of the end guide sheaves 75 and more than 180° around each of the carriage supported sheaves 40 and then over the other guide sheave 75 at the opposite or right end of the rope stretcher 10. The rope R then extends around the end portions of the rolls (not shown) of the papermaking or web processing machine. Referring to FIG. 4, a series of longitudinally spaced angle brackets 77 are secured to the other flange 14 of the H-beam 12 and support a right angle sheet metal cover guard 80 which extends the full length of the beam 12.

Figure 5:
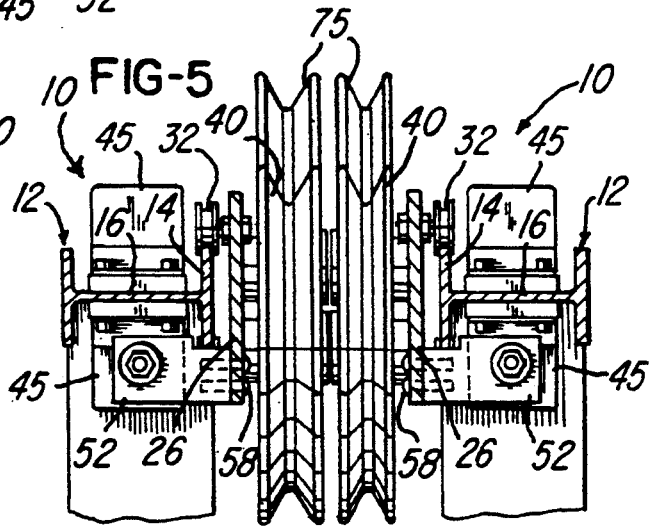
FIG. 5 is a section similar to FIG. 4 of dual tensioning apparatus constructed.

Referring to FIG. 5, a pair of the rope stretchers 10 described above in connection with FIGS. 1–4 are arranged in adjacent relation to form a double rope stretcher for handling a pair of endless ropes. Preferably, when two of the rope stretchers 10 are used, they are arranged so that the sheaves 40 define adjacent parallel paths with the sheaves positioned in closely spaced opposing relation. The end support brackets 20 for each H-beam frame 12 are rigidly secured together by welding a connecting bottom plate (not shown).

As shown in FIG. 2, when fluid is supplied to the cylinders 45 at a predetermined pressure, the outward forces on the piston rods 48 tend to separate the sheaves 40 and maintain a predetermined tension within the rope R according to the selected pressure within the cylinders 45. In order to detect the extent of stretch within the rope R as compensated for by the outwardly movable carriages 25, a pair of electronic proximity sensors 82 are supported by the opposite end portions 18 of the H-beam 12 directly above the mounting brackets 20. Each of the sensors 82 detects when the corresponding carriage 25 is within a predetermined distance, for example, about ten inches. When both of the sensors 82 are activated, an electrical circuit closes to activate a flashing light or an audible alarm for indicating that the maximum allowable stretch within the rope R is approaching.

FIGS. 1–5 illustrate installation of the rope stretcher of the invention in essentially a horizontal position, which is the most common position. There are situations, however, when the available space on a paper machine is such that the rope stretcher must be mounted vertically or in an inclined position with the horizontal. Such a vertical installation is illustrated diagrammatically in FIG. 6 for the rope stretcher 10, which is of the same overall construction already described, and which has its mounting brackets 20 secured to portions 90 of a papermaking machine that are so located that the frame 12 extends substantially vertically.

Figure 6:
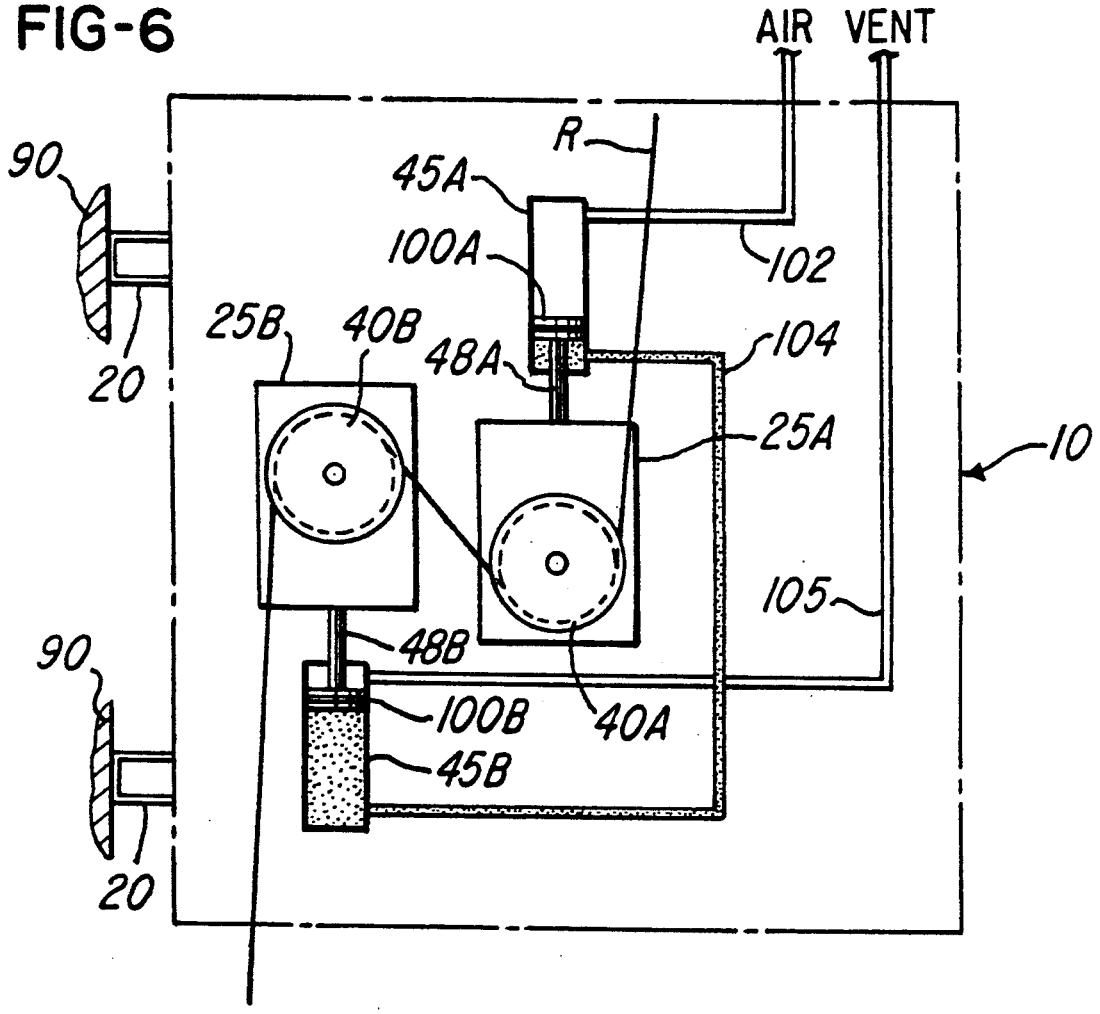
FIG. 6 is a diagrammatic view of the rope stretcher shown in FIGS. 1–4 and modified in accordance with the invention for also mounting in a vertical or inclined position.

In FIG. 6, one of the operating cylinders for the sheave-bearing carriages is designated 45A, and the associated carriage is designated 5A, while the other cylinder and carriage are designated 45B and 25B, respectively. In the orientation of the rope stretcher in FIG. 6, the piston rod 48A depends from the cylinder 45A, and the associated air actuated piston 100A moves downwardly to exert tension on the loop of rope R encircling the sheaves 40A and 40B. Thus the weight of the carriage 25A and the parts carried thereby is added to the tensioning force exerted by air pressure on piston 100A.

The other cylinder 45B, however, has its piston rod 48B extending upwardly therefrom. The air pressure on piston 100B to produce a tensioning force on the rope loop must therefore also overcome the weight of the carriage 25B and the parts which move with the carriage. The present invention provides novel means for counterbalancing these disparate gravitational Forces, as now described.

Referring to FIG. 6, the upper end of cylinder 45A is connected by a line 102 to a source of operating fluid pressure, commonly pressurized air, which will force piston 100A downwardly. A line or conduit 104 connects the lower end of cylinder 45A below its piston 100A with the lower end of cylinder 45B, below its piston 100B. The upper end of cylinder 45B is provided with a vent line 105 to atmosphere. The line 104, which is preferably a high pressure hose or metal tubing, and the lower portions of cylinders 45A and 45B are filled with hydraulic fluid to form a closed hydraulic circuit. The downward movement of piston 100A, carriage 25A and sheave 40A results in corresponding upward movement of piston 100B and carriage 25B and sheave 40B. Thus the air pressure within the line 102 operates on both carriages 25A and 25B and controls the tension exerted on the rope R. The cylinder 45A may be slightly larger in diameter than the cylinder 45B to compensate for the unequal piston area exposed to the hydraulic fluid if equal piston rod strokes are desired.

This form of the invention offers practical advantages, especially for use whenever the configuration of the papermaking machine makes it more practical to mount a rope stretcher with the mounting brackets 20 in a position other than horizontal so that gravitational forces cause the respective sheave-supporting carriages to have different effective weights. These weights require different pressure loading of the operating cylinders if both cylinders are separately operated. For example, in some sizes of stretchers, the gravity effects are so large that the downward moving sheave tensions the rope too much even with no supply pressure. In contrast, the present invention results in the effective tensioning pressure applied to each carriage to be effectively the same, and no compensation in fluid pressure is needed for the difference in gravitational loads on the two carriages.

While the form of tensioning apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus adapted for tensioning an endless rope used for threading a web in a papermaking machine and for taking up stretch which develops in a rope over a period of use, said apparatus comprising means forming an elongated track, a pair of carriages mounted for movement on said track towards and away from each other, a sheave mounted on each of said carriages for free rotation and positioned to receive at least a partial wrap of the rope, a separate fluid pressure actuated cylinder mounted on said track for each of said carriages, each of said cylinders enclosing a piston connected to a piston rod projecting from one end of said cylinder, said cylinders being positioned on said track with said piston rods extending therefrom in opposite directions, means for connecting each said piston rod to the corresponding said carriage, means for applying fluid operating pressure to one of said cylinders to move the corresponding said piston and piston rod in one direction within said cylinder, means defining a fluid passage interconnecting portions of said cylinders, and said passage and said cylinder portions interconnected thereby being filled with hydraulic fluid to cause said piston in the other said cylinder to move in the opposite direction in response to fluid operating pressure applied to said piston in said one cylinder.

2. Apparatus as defined in claim 1 wherein said fluid operating pressure is air, and opposite end portions of said cylinders are connected by said passage filled with hydraulic fluid.

3. Apparatus as defined in claim 1 further comprising means for mounting said track with said track extending at an angle to the horizontal and with said piston rod of said one cylinder extending downwardly from said cylinder.

4. The combination of a papermaking machine, an endless rope for threading a web in said papermaking machine, and apparatus for tensioning said rope and for taking up stretch which develops in said rope over a period of use, said apparatus comprising a beam forming an elongated track, means for mounting said beam on said papermaking machine with said track extending at an angle to the horizontal, a pair of carriages mounted for movement on said track towards and away from each other, each of said carriages having a sheave mounted for free rotation thereon in position to receive a partial wrap of said rope, a separate fluid pressure actuated cylinder associated with each of said carriages and mounted on said beam, each of said cylinders enclosing a piston connected to a piston rod projecting from said cylinder and connected to the associated said carriage, one of said cylinders having the associated said piston rod extending downwardly therefrom and the second of said cylinders having the associated said piston rod extending upwardly therefrom, means for applying operating fluid pressure to one end portion of one of said cylinders to force the corresponding said piston and piston rod to move in one direction, means for venting the opposite end portion of the other said cylinder, means forming a hydraulic fluid connection between the opposite end portions of said cylinders, and hydraulic fluid filling said fluid connection and said opposite end portions of said cylinders to cause said pistons in said cylinders to move in opposite directions in response to each other.

5. Apparatus as defined in claim 4 wherein said operating fluid pressure is pressurized air.

6. The combination defined in claim 4 wherein said beam comprises a substantially flat flange having opposite longitudinal edge portions forming said track, and each of said carriages includes a set of grooved wheels engaging said edge portions of said flange to hold said carriages on said track.

7. Apparatus as defined in claim 4 wherein one of said cylinders is slightly larger in diameter than the other said cylinder.

8. Apparatus adapted for tensioning an endless rope used for threading a web in a papermaking machine and for taking up stretch which develops in the rope over a period of use, said apparatus comprising a frame including an elongated beam having at least one longitudinally extending and substantially flat flange with longitudinally extending opposite edge portions, a set of carriages each including a base member disposed adjacent and substantially parallel to said flange, said base member of each said carriage having a width greater than the width of said flange, a set of spaced wheels mounted on said base member of each said carriage and engaging said edge portions of said flange with said flange extending between said wheels to support said carriage for longitudinal movement along said beam, a set of elongated fluid cylinders supported by said beam and extending longitudinally of said beam in opposite directions, each said cylinder having opposite end portions and a piston rod movable longitudinally of said beam, means for connecting said piston rod of each said cylinder to the corresponding said carriage and providing for movement of said carriage along said flange in response to actuation of the corresponding said cylinder, a guide sheave supported by said base member of each said carriage for free rotation and positioned to engage the rope, and means forming a hydraulic fluid-filled connection between opposite said end portions of said cylinders.

9. Apparatus as defined in claim 8 and including means for positioning said frame with said beam extending at an angle with respect to the horizontal.

10. Apparatus as defined in claim 9 wherein each of said cylinders has upper and lower said end portions, said piston rod of one of said cylinders projects downwardly from said lower end portion of one of said cylinders, and said piston rod of the other said cylinder projects upwardly from said upper end portion of the other said cylinder.

* * * * *